US008333150B2

(12) United States Patent
Schaedlich et al.

(10) Patent No.: US 8,333,150 B2
(45) Date of Patent: Dec. 18, 2012

(54) METHOD FOR OPERATING A WEB-FED PRINTING PRESS

(75) Inventors: Ralf Schaedlich, Plauen (DE); Klaus Toepfer, Muehltroff (DE); Thomas Wunderlich, Plauen (DE)

(73) Assignee: manroland AG, Offenbach/Main (DE)

( * ) Notice: Subject to any disclaimer, the term of this patent is extended or adjusted under 35 U.S.C. 154(b) by 659 days.

(21) Appl. No.: 12/509,179

(22) Filed: Jul. 24, 2009

(65) Prior Publication Data

US 2010/0018425 A1 Jan. 28, 2010

(30) Foreign Application Priority Data

Jul. 26, 2008 (DE) ..... 10 2008 034 943

(51) Int. Cl.
*B41F 33/12* (2006.01)
*B41F 33/16* (2006.01)

(52) U.S. Cl. ..... 101/484; 101/219

(58) Field of Classification Search ..... 101/219, 101/483, 484; *B41F 33/12, 33/16*
See application file for complete search history.

(56) References Cited

U.S. PATENT DOCUMENTS

2005/0199151 A1* 9/2005 Holten et al. ..... 101/484

FOREIGN PATENT DOCUMENTS

DE 29 22 964 A1 12/1979
DE 197 39 283 A1 3/1999
DE 10 2004 005 602 A1 9/2005

* cited by examiner

*Primary Examiner* — Leslie J Evanisko
(74) *Attorney, Agent, or Firm* — Crowell & Moring LLP

(57) ABSTRACT

A method for starting up a web-fed printing press is disclosed. In an embodiment, the method includes: a) a first start-up sequence is executed while using predetermined preset parameters that are specific to the printing press and/or the print job for the color register adjustment, cut-off compensator control and the ink density control; b) the web-fed printing press is subsequently stopped, where copies printed during the first start-up sequence are evaluated with respect to the color register, the cut-off compensator and the ink density, and where the preset parameters are adjusted as a function of this evaluation while the printing press is stopped; c) following this, a second start-up sequence is executed, where the preset parameters that are adjusted during the standstill are not used for printing until defined printing press speeds are reached and/or exceeded.

13 Claims, 1 Drawing Sheet

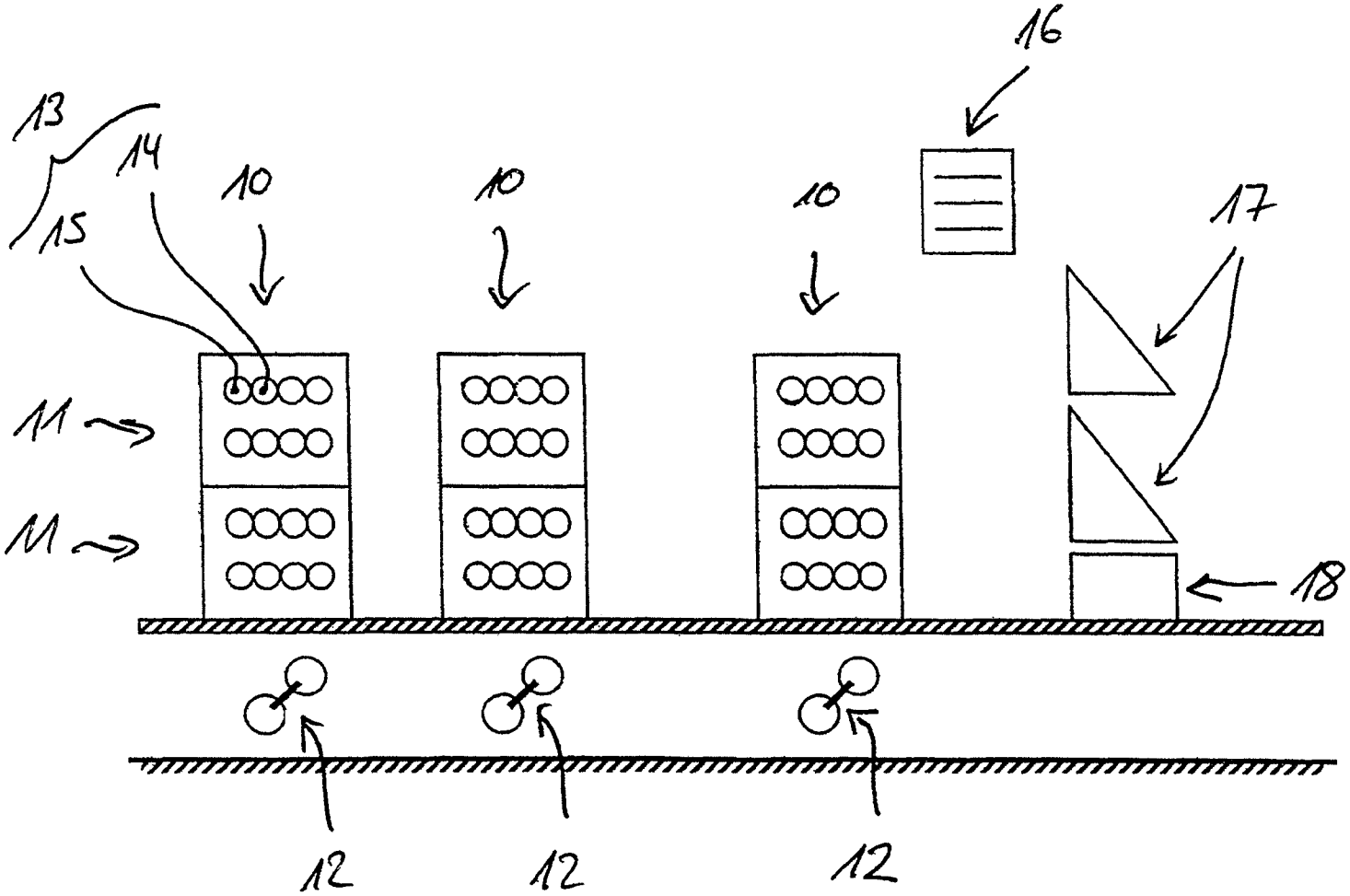
16
17
18
10
10
10
12
12
12
13
14
15
11
11

METHOD FOR OPERATING A WEB-FED PRINTING PRESS

This application claims the priority of German Patent Document No. 10 2008 034 943.7, filed Jul. 26, 2008, the disclosure of which is expressly incorporated by reference herein.

BACKGROUND AND SUMMARY OF THE INVENTION

The invention relates to method for operating a web-fed printing press.

Web-fed printing presses, such as newspaper printing presses, for example, are extremely complex and highly productive mechanical systems. When operating a web-fed printing press, starting up the web-fed printing press is one of the most complex processes during production. Thus, start-up of a web-fed printing press must take place using a time table that is meticulous to the minute, which depends, on the one hand, on the editorial deadline and, on the other hand, on the point in time at which wastage-free printed products must be available to the shipping department. Moreover, because of increasing paper prices, the wasted paper generated when starting up a web-fed printing press must be reduced, whereby the start-up wastage should be understood as the number of printed products that are produced during start up, but that still do not meet the required quality criteria, and consequently, cannot be delivered to customers.

The decision about whether a printed product meets the quality requirements or is considered wasted paper is made taking the quality criteria of ink density, color register, and cut-off compensator into account, wherein these quality criteria must be met or complied with on all pages of the printed product.

In order to influence the ink density, color register, and cut-off compensator, a web-fed printing press comprises an ink density control, a color register adjustment, and a cut-off compensator control. The person skilled in the art who is being addressed here is familiar with these types of control devices and, as a result, they require no further explanation.

In order to print wastage-free within the shortest period of time after start-up of a web-fed printing press, the color register adjustment device, the ink density control device, and the cut-off compensator control device must be functioning within the shortest period of time using sets of parameters, whose use permits the quality criteria to be met on all pages of the printed product. Until now, there was no method known from the prior art that could guarantee this. As a result, there is a need for a method for operating a web-fed printing press, wherein printed products can be printed that meet the quality criteria of ink density, color register, and cut-off compensator within the shortest period of time while minimizing start-up wastage.

Starting herefrom, the present invention is based on the objective of creating a novel method for operating a web-fed printing press.

According to an embodiment of the invention, the following steps are executed in succession: a) a first start-up sequence is executed while using the predetermined preset parameters that are specific to the printing press and/or the print job for the color register adjustment, cut-off compensator control, and the ink density control; b) the web-fed printing press is subsequently stopped, wherein copies printed during the first start-up sequence are evaluated with respect to the color register, the cut-off compensator, and the ink density, and wherein the preset parameters for the color register adjustment and/or the cut-off compensator control and/or ink density control are adjusted as a function of this evaluation while the printing press is at a standstill; c) following this, a second start-up sequence is executed, wherein, in this connection, the preset parameters for the color register adjustment and/or the cut-off compensator control and/or the ink density control that are adjusted during the standstill are not used for printing until defined printing press speeds are reached and/or exceeded.

The inventive method provides that a first start-up sequence be executed while using the preset parameters that are specific to the printing press and/or the print job for the cut-off compensator control, the color register adjustment, and the ink density control. Subsequent to this, the web-fed printing press is stopped in order to evaluate, during the standstill, the copies printed during the first start-up sequence with respect to the ink density, color register, and cut-off compensator.

According to an embodiment of the invention, the preset parameters for the color register adjustment and/or the cut-off compensator control and/or the ink density control are adjusted during the standstill as a function of this evaluation. During a subsequent second start-up sequence, the adjusted preset parameters are used, namely as a function of reaching and/or exceeding defined printing press speeds. It is possible with the inventive method to start up a web-fed printing press within the shortest period of time while minimizing start-up wastage.

Preferred further developments of the invention are disclosed in the following description. Without being limited hereto, one exemplary embodiment of the invention is explained in greater detail on the basis of the drawing.

BRIEF DESCRIPTION OF THE DRAWING

The sole drawing figure is a schematic representation of a web-fed printing press.

DETAILED DESCRIPTION OF THE DRAWING

The present invention relates to the operation of a web-fed printing press, namely starting up a web-fed printing press while minimizing the time required for start-up as well as while minimizing the wastage generated during start-up.

The drawing figure shows a schematic representation of a web-fed printing press, which in the depicted exemplary embodiment is comprised of three printing towers 10 each made up of two printing units 11 positioned in a vertically stacked manner, wherein every printing tower 10 is assigned a reel splicer 12. Each of the printing units 11 of each one of the printing towers 10 has four printing couples 13 in the depicted exemplary embodiment, wherein only the transfer cylinders 14 and plate cylinders 15 of the printing couples 13 are shown. In addition to the printing towers 10 and the reel splicers 12, the web-fed printing press in the figure is also comprised of a turner bar unit 16, a folder superstructure featuring two formers 17, and a folder 18. The web- fed printing press depicted in the figure is a newspaper printing press on which newspaper products are printed as printed products.

In order to produce high-quality printed newspaper products, the web-fed printing press shown as an example in the figure is comprised of a color register adjustment device (not shown), a cut-off compensator control device (not shown) and an ink density control device (not shown) in order to regulate the color register, the cut-off compensator, and the ink density, each of which represent important quality criteria for a newspaper product.

To start up the newspaper printing press depicted in the figure, it is provided within the scope of the present invention that preset parameters that are specific to the printing press and/or the print job for the color register adjustment, cut-off compensator control, and the ink density control are used in a first start-up sequence. The parameters used as preset parameters for the color register adjustment in the first start-up sequence are those parameters which were determined during the commissioning of the web-fed printing press, and consequently, are printing-press-specific. These printing-press-specific preset parameters are preferably stored in a memory of a control system of the web-fed printing press and are used as the preset parameters for the color register adjustment during the first start-up sequence.

The parameters used in the first start-up sequence as preset parameters for the ink density control are print-job-specific parameters which are made available from the preliminary stage as a function of the to-be-printed print job, namely by a printing preliminary stage system. These print-job-specific preset parameters for the ink density control are used during the first start-up sequence.

Used as preset parameters for the cut-off compensator control during the first start-up sequence are parameters that are a function of the web path and the number of pages of the printed product, i.e., which are print-job-specific, on the one hand, and printing-press-specific, on the other hand. These preset parameters for the cut-off compensator control are preferably made available by a production planning system of the printing press.

The preset parameters used in the first start-up sequence preset parameters for the color register adjustment, the cut-off compensator control, and the ink density control are made available automatically and used automatically for the first start-up sequence when starting up the web-fed printing press.

Following the first start-up sequence, the web-fed printing press is stopped, namely either when a defined period of time for the first start-up sequence has lapsed or after a defined number of newspaper products has been printed. After the web-fed printing press has stopped, printed newspaper products that were printed during the first start-up sequence are evaluated while the web-fed printing press is stopped with respect to the color register, the cut-off compensator, and the ink density, wherein the preset parameters for the color register adjustment and/or the cut-off compensator control and/or the ink density control are adjusted as a function of this evaluation while the web-fed printing press is stopped, and thus, at a standstill.

It is within the scope of the present invention that, during the standstill of the web-fed printing press, both the preset parameters for the color register adjustment as well as for the cut-off compensator control as well as for the ink density control can be adjusted, and that this adjustment takes place, however, as a function of the evaluation of the printed newspaper products that were printed during the first start-up sequence. The evaluation of the printed newspaper products that were printed during the first start-up sequence as well as the contingent adjustment of the preset parameters for the color register adjustment and/or the cut-off compensator control and/or the ink density control can take place automatically or in an automated manner. An automatic evaluation and adjustment should be understood as a process in which printed products are automatically evaluated by sensors and the preset parameters are adjusted automatically as a function thereof. An automated evaluation and adjustment should be understood to mean that a printer evaluates the copies of the newspaper printed during the first start-up sequence and modifies or adjusts the preset parameters as a function thereof.

Following this, within the scope of the invention, a second start-up sequence is executed, namely with the use of the preset parameters for the color register adjustment and/or the cut-off compensator control and/or the ink density control that are adjusted during the standstill, wherein at least some preset parameters are not actually used during the second start-up sequence until defined printing press speeds are reached and/or exceeded.

Thus, the preset parameters for the cut-off compensator control that are adjusted during the standstill are used immediately at the start of the second start-up sequence, i.e., immediately when the printing press speed deviates from zero. The preset parameters for the ink density control that are adjusted during the standstill are then used once a first defined printing press speed is reached or exceeded after the start of the second start-up sequence.

The preset parameters for the color register adjustment that are adjusted during the standstill are then used once a second defined printing press speed is reached or exceeded after the start of the second start-up sequence, wherein the second defined printing press speed is greater than the first defined printing press speed.

According to an advantageous further development of the present invention, infeed mechanisms (not shown) downstream from the printing units 11, which are used to transport the printed printing substrate, are incorporated into a position regulator of a main drive axis of the web-fed printing press, thereby allowing the cut-off compensator control to be improved. Furthermore, infeed mechanisms having a high coefficient of friction or a high grip value are preferably used in order to improve the cut-off compensator control. When infeed mechanisms having a high coefficient of friction are used, slippage between the infeed mechanisms and the printing substrate being transported can be minimized.

The inventive method makes it possible to start up a web-fed printing press within a short period of time while minimizing start-up wastage. It is possible to produce marketable printed newspaper products already with the second start-up sequence.

LIST OF REFERENCE NUMBERS

10 Printing tower
11 Printing unit
12 Reel splicer
13 Printing couple
14 Transfer cylinder
15 Plate cylinder
16 Turner bar unit
17 Former
18 Folder The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for starting up a web-fed printing press while minimizing a time required for start-up and a number of wasted copies generated during the start-up, comprising the steps of:

executing a first start-up sequence while using predetermined preset parameters that are specific to the printing press and/or a print job for a color register adjustment, a cut-off compensator control, and an ink density control;

subsequently stopping the web-fed printing press;

evaluating copies printed during the first start-up sequence with respect to a color register, a cut-off compensator, and an ink density;

adjusting the predetermined preset parameters for the color register adjustment, and/or the cut-off compensator control, and/or the ink density control as a function of the evaluating step while the printing press is stopped;

subsequently starting a second start-up sequence using the predetermined preset parameters for the cut-off compensator control; and using the predetermined parameters for the ink density control once a defined printing press speed is reached and/or exceeded after starting the second start-up sequence.

2. The method according to claim 1, wherein printing-press-specific preset parameters determined during a commissioning of the web-fed printing press are used as the predetermined preset parameters for the color register adjustment during the first start-up sequence, and the predetermined preset parameters are stored in a memory of a control system of the web-fed printing press.

3. The method according to claim 1, wherein print-job-specific preset parameters from a preliminary stage are used as the predetermined preset parameters for the ink density control during the first start-up sequence, and the predetermined preset parameters are made available by a printing preliminary stage system.

4. The method according to claim 1, wherein print-job-specific preset parameters that are a function of a web path and a number of pages of a printed product are used as the predetermined preset parameters for the cut-off compensator control during the first start-up sequence, and the predetermined preset parameters are made available by a production planning system.

5. The method according to claim 1, wherein the predetermined preset parameters of the first start-up sequence are made available automatically to a control device and used automatically for the first start-up sequence.

6. The method according to claim 1, wherein the step of evaluating and the step of adjusting take place automatically or in an automated manner.

7. The method according to claim 1, wherein the predetermined preset parameters for the cut-off compensator control that are adjusted in the adjusting step are used immediately at a start of the second start-up sequence.

8. The method according to claim 1, wherein the predetermined preset parameters for the ink density control that are adjusted during the adjusting step are used only when said defined printing press speed is reached or exceeded after a start of the second start-up sequence.

9. The method according to claim 8, wherein said defined printing press speed is a first defined printing press speed, and the predetermined preset parameters for the color register adjustment that are adjusted during the adjusting step are used when a second defined printing press speed is reached or exceeded after the start of the second start-up sequence.

10. The method according to claim 9, wherein the second defined printing press speed is greater than the first defined printing press speed.

11. The method according to claim 1, wherein an infeed mechanism downstream from a printing unit is incorporated into a position regulator of a main drive axis of the web-fed printing press.

12. The method according to claim 11, wherein the infeed mechanism has a high coefficient of friction.

13. The method according to claim 1, wherein the web-fed printing press is a newspaper printing press.

* * * * *